US010822063B1

(12) United States Patent
Barnes

(10) Patent No.: US 10,822,063 B1
(45) Date of Patent: Nov. 3, 2020

(54) FLOATING PLATFORM

(71) Applicant: Sean A. Barnes, Mt. Pleasant, SC (US)

(72) Inventor: Sean A. Barnes, Mt. Pleasant, SC (US)

( * ) Notice: Subject to any disclaimer, the term of this patent is extended or adjusted under 35 U.S.C. 154(b) by 0 days.

(21) Appl. No.: 16/794,670

(22) Filed: Feb. 19, 2020

Related U.S. Application Data

(63) Continuation-in-part of application No. 29/722,469, filed on Jan. 30, 2020.

(51) Int. Cl.
*B63C 1/02* (2006.01)

(52) U.S. Cl.
CPC ..... *B63C 1/02* (2013.01)

(58) Field of Classification Search
CPC ..... B63C 1/02
See application file for complete search history.

(56) References Cited

U.S. PATENT DOCUMENTS

| | | | | |
|---|---|---|---|---|
| 3,074,239 | A | 1/1963 | Mustard | |
| 3,270,698 | A | 9/1966 | Fort | |
| RE27,090 | E | 3/1971 | Rutter | |
| 3,603,276 | A | 9/1971 | De Lisle | |
| 3,727,415 | A | 4/1973 | Williams | |
| 3,967,570 | A | 7/1976 | Bradfield | |
| 4,018,179 | A | 4/1977 | Rutter | |
| 4,072,119 | A | 2/1978 | Williams | |
| 4,276,849 | A | 7/1981 | Bloxham | |
| 4,280,429 | A | 7/1981 | Wells | |
| 4,510,877 | A | 4/1985 | Bloxham | |
| 4,641,595 | A | 2/1987 | Pritchett | |
| 4,763,592 | A | 8/1988 | Russ | |
| 4,782,778 | A | 11/1988 | Barbaglia | |
| 4,948,300 | A * | 8/1990 | Bateson | E02B 3/068 405/220 |
| 5,002,000 | A | 3/1991 | Rutter | |
| 5,016,551 | A | 5/1991 | Peck et al. | |
| 5,046,897 | A | 9/1991 | Ray | |

(Continued)

FOREIGN PATENT DOCUMENTS

| | | |
|---|---|---|
| DE | 2042850 | 3/1972 |
| FR | 3017595 | 6/2014 |
| WO | WO2014035026 | 3/2014 |

OTHER PUBLICATIONS https://www.jetdock.com (excerpt printed Jan. 29, 2020).

(Continued)

*Primary Examiner* — S. Joseph Morano
*Assistant Examiner* — Jovon E Hayes
(74) *Attorney, Agent, or Firm* — B. Craig Killough

(57) ABSTRACT

A floating platform has a floating member. The floating member is attached to another object, which may be fixed to the earth or it may be a floating object such as a floating dock or a vessel. At least two guide posts each have a horizontal blade extending from them. Each blade slidably engages a bracket that is mounted to the object, with the slidable blade permitting horizontal adjustment of the distance of the floating member from the object. The floating member has at least two horizontal receptacles extending through the floating member. Guide posts slidably engage the receptacles, permitting the floating member to move vertically relative to the guide posts, which fix the floating member's horizontal position relative to the object.

12 Claims, 4 Drawing Sheets

(56) References Cited

U.S. PATENT DOCUMENTS

| | | | | |
|---|---|---|---|---|
| 5,106,237 | A * | 4/1992 | Meldrum | E02B 3/068 405/221 |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A | 1/1999 | Moody | |
| 5,860,765 | A | 1/1999 | Cruchelow et al. | |
| 6,145,463 | A | 11/2000 | Zeilinger | |
| 6,179,525 | B1 | 1/2001 | Gruhn et al. | |
| 6,477,968 | B2 | 11/2002 | Powell | |
| 65,226,902 | | 3/2003 | Faber | |
| 6,547,485 | B2 | 4/2003 | Elson | |
| 6,648,554 | B1 * | 11/2003 | Sehl | B63B 21/50 114/351 |
| D506,668 | S | 6/2005 | Black | |
| 7,153,064 | B2 | 12/2006 | Zeilinger et al. | |
| 7,390,141 | B2 | 6/2008 | Rytand | |
| 7,406,924 | B1 | 8/2008 | Impey | |
| 8,267,621 | B1 | 9/2012 | Way | |
| 8,528,494 | B2 * | 9/2013 | Moody | B63B 59/02 114/263 |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| 10,000,902 | B1 * | 6/2018 | Huml | E02B 3/068 |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 * | 4/2019 | Barnes | E02B 3/064 |
| 10,370,073 | B2 | 8/2019 | Barnes | |
| 2002/0131821 | A1 | 9/2002 | Elson | |
| 2005/0002741 | A1 | 1/2005 | Brensinger et al. | |
| 2005/0271477 | A1 | 12/2005 | Sehl | |
| 2006/0156964 | A1 | 7/2006 | Canniffe et al. | |
| 2007/0248420 | A1 * | 10/2007 | Jacobs | F16B 7/044 405/218 |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2009/0302572 | A1 * | 12/2009 | Bryant, II | B60P 3/1066 280/414.1 |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2014/0010593 | A1 | 1/2014 | Davis | |

OTHER PUBLICATIONS

Shoremaster, LLC, Official RhinoHoist Front Mount Floating Boat Life Video, YouTube, May 10, 2013, https://www.youtube.com/watch?v-ayxgoTHCijl.

* cited by examiner

FLOATING PLATFORM

Floating platforms, such as docks and rafts, are used to store boats, stage materials, or provide walkways over water. There is a need for a floating dock that can be quickly constructed, and will float on top of water as water levels change due to tides, wave action and other causes.

SUMMARY OF THE INVENTION

The present invention is a floating platform that has a floating member. The floating member is attached to another object, which may be fixed to the earth or it may be a floating object such as a floating dock or a vessel. At least two guide posts each have a horizontal blade extending from them. Each blade slidably engages a bracket that is mounted to the object, with the slidable blade permitting horizontal adjustment of the distance of the floating member from the object.

The floating member has at least two horizontal receptacles extending through the floating member. Guide posts slidably engage the receptacles, permitting the floating member to move vertically relative to the guide posts, which fix the floating member's horizontal position relative to the object. The floating platform is useful in marine applications.

BRIEF DRAWING DESCRIPTION

DESCRIPTION OF PREFERRED EMBODIMENTS

Figure 1:
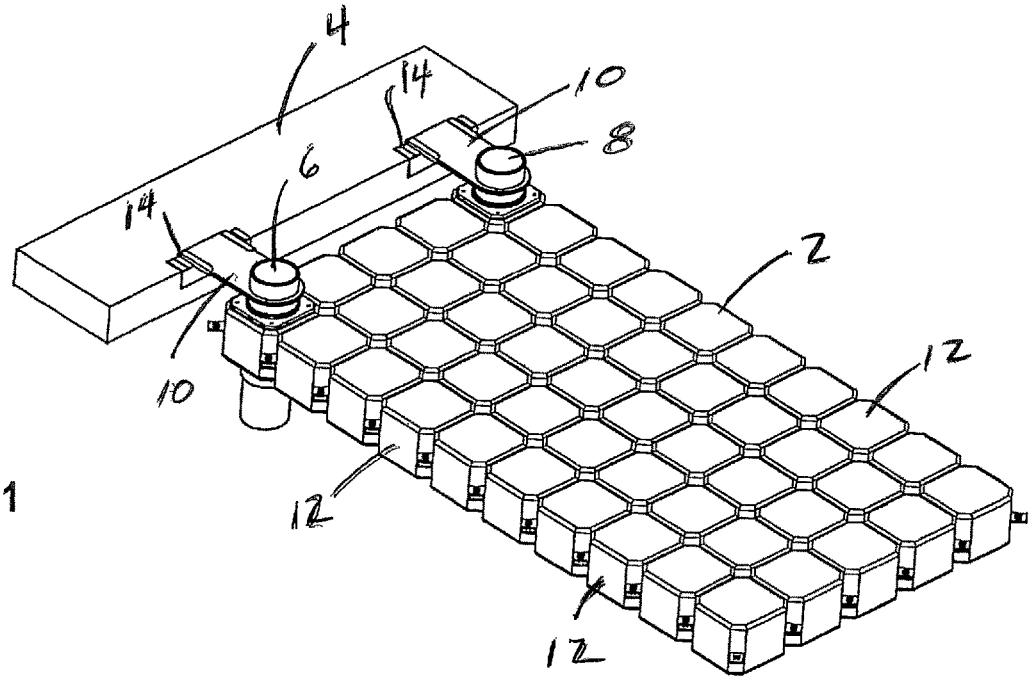
FIG. 1 is a perspective view of the floating platform according to the invention.
Figure 2:
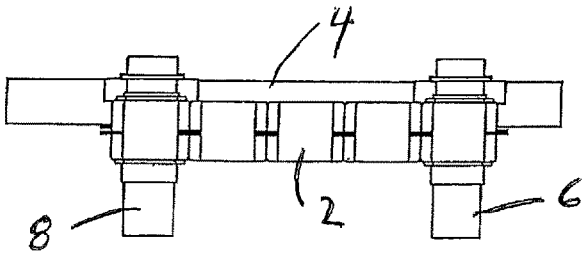
FIG. 2 is an elevation of the end the floating platform according to the invention.
Figure 3:
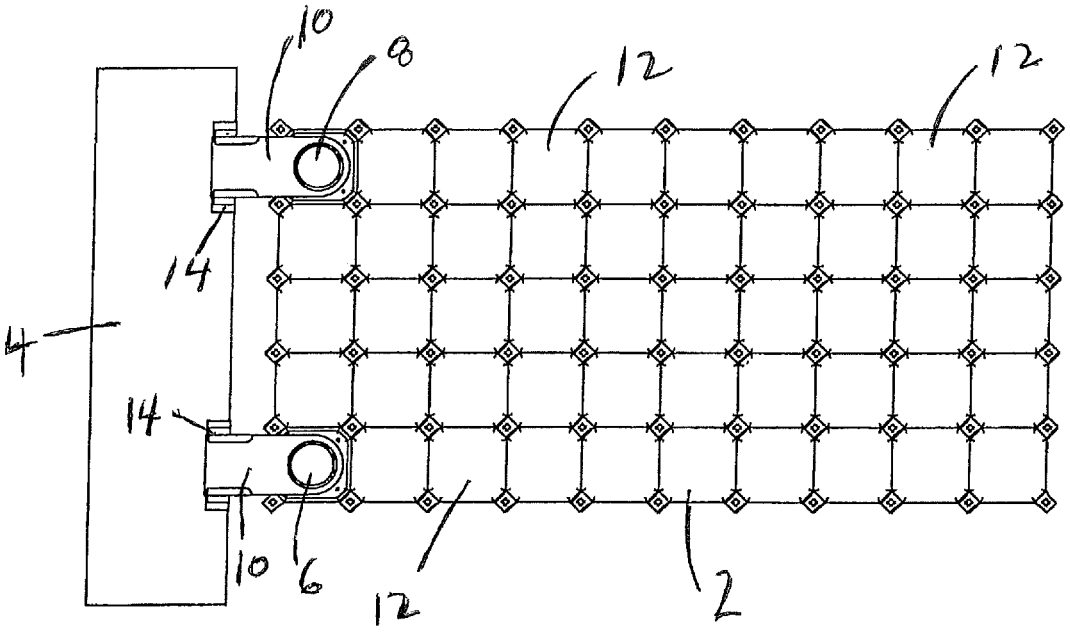
FIG. 3 is a top plan view of the floating platform.
Figure 4:
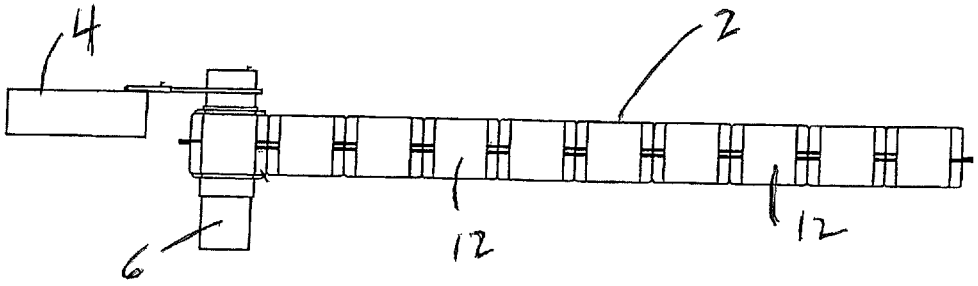
FIG. 4 is a side elevation of the floating platform.
Figure 5:
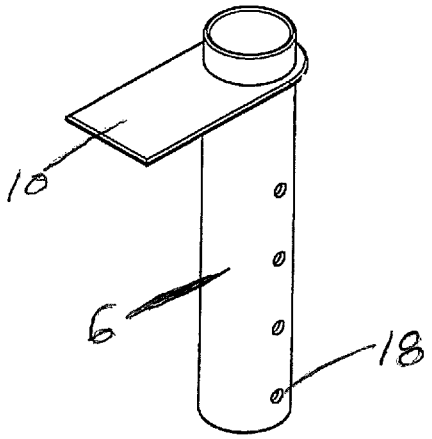
FIG. 5 is a perspective view of a guide post used with the invention.
Figure 6:
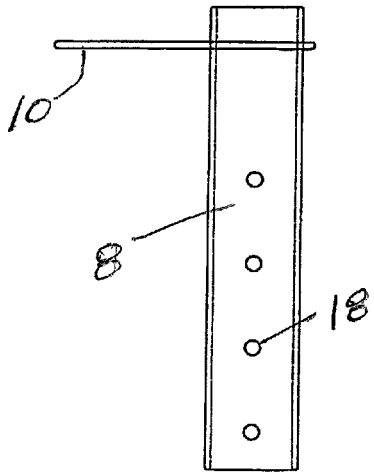
FIG. 6 is an elevation of the guide post shown in FIG. 5.
Figure 7:
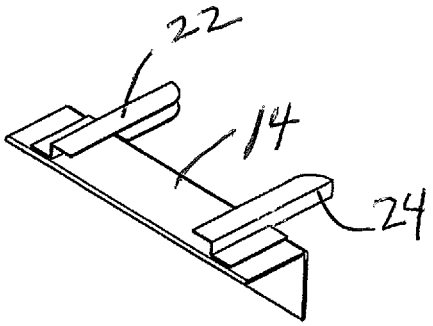
FIG. 7 is a perspective view of a bracket for receiving a blade of the guide post.

The floating platform comprises a floating member 2. The floating member may be a floating dock or similar platform that will float in water. The floating member may be formed of wood, plastic or other materials that will float in water. As shown in the drawing figures, the floating member is formed of a plurality of individual floating units 12 that are connected to form a rectangular floating member. The floating member as shown in FIG. 1 also has a generally level and planar top surface and can be used as a boat dock with the boat stored on top of the boat dock. The floating member may be used as a staging area for tools and materials, or the floating member may be used as a walkway, such as a catwalk. The floating member may be formed in shapes other than a rectangular shape, and need not have a planar top surface.

Forming the floating member 2 of individual floating units 12 allows the floating member to be constructed in a desired shape and dimensions, and also allows quick assembly of the floating platform. The floating platform has particular utility as a temporary facility that can be quickly assembled. Further, the use of individual units to form the floating member, or the use of other modular construction of the floating member, allows for easy transportation of the floating platform which can be assembled on site, and without the necessity of special highway transportation.

The invention allows the floating member 2 to be held in place relative to another object 4 without substantial horizontal movement of the floating platform. However, the floating platform according to the invention allows vertical movement of the floating member relative to the object due to changes in water levels due to tides, weather, or wave action. The object may be in position relative to the earth or the object may be another floating object. For example, the object could be a bulkhead fixed to the shore, or the object could be another floating platform or floating dock or the additional object could be a vessel, such as a ship or a boat. Whether the object is fixed or floating, the floating platform construct of the invention allows vertical movement of the floating member relative to the object while holding the floating platform substantially in position horizontally, although the horizontal positioning may be adjusted.

Guide posts 6,8 are used to connect the floating member 2 to the object 4. A preferred guide post is an elongated object that engages receptacles formed in and extending through the floating member. The guide posts each comprise a horizontal blade 10 that extends from a side of the guide post and near a top of the guide post.

In a preferred embodiment, at least two brackets 14 are mounted to the object 4. Each bracket has opposing members 22,24 that allow the blade 10 of a guide post 6,8 to slidably engage the bracket between the opposing members. The blade may be formed to a desired length, so that the floating member 2 may be horizontally spaced from the object at a desired distance. With the blade being slidable within the brackets, this distance may be adjusted as desired by the user. After positioning the blades between the brackets, the distance of the floating member to the object is adjusted and the blade is fixed to a position within the brackets such as by using a set screw to hold the blade and the guide post in a horizontal position relative to the object. The guide posts thereby hold the floating member in a horizontal position relative to the object. The blades of the guide posts are positioned above the floating member.

The guide posts 6,8 engage receptacles formed in and extending through the floating member 2. The guide posts are fixed in position relative to the object as described above, but the floating member moves vertically relative to the guide posts as the floating member floats in changing water levels. The fit of the guide posts within the receptacles is such that the receptacles, and therefore the floating member, can traverse the guide posts in a vertical direction. The floating member can move vertically independent of the object 4 to which the floating platform is attached. In this manner, if the object is fixed to the earth, changes in water levels do not submerge the floating member. Similarly, if the floating platform is attached to a floating object, such as a large vessel, the floating object has less tendency to pull the floating platform under the water in the event of violent wave action.

The guide posts 6,8 may be formed to a length that is required by the application. For example, if the object 4 is fixed to the earth and the floating platform 2 is subject to two (2) meter tides, the guide posts may have a length of three (3) meters or more. In some applications it may be desirable to have a stop on the guide posts. The stop may be a pin inserted through a void 18 of the guide post so that the floating member does not disengage from the guide post in the event of an extremely low water level due to tides, wave action or other causes.

The guide posts 6,8 may have a round cross section, and form an elongated cylindrical shape. If the guide posts are hollow, a cap may be placed over the top of the guide posts, so that the guide post may be used as a step for entering or leaving the floating member 2. The receptacles are formed as voids having a complementary shape to the guide posts so that the floating member moves vertically the guide posts as water levels change. The guide posts and receptacles could have other complimentary shapes. The receptacles and guide posts are preferred to be formed of polyethylene, and particularly high density polyethylene, which is extremely durable, corrosion resistant, and has low friction qualities that facilitate the movement required by the objects of the invention. Low density polyethylene may be used in other applications.

In a preferred embodiment, the guide posts have a specific gravity of less than 1.0 so that they float in water and provide buoyancy to retard deflection of the blade over time. In a specific embodiment the guide posts are hollow but are capped or otherwise sealed to prevent water intrusion into the center of the guide posts so as to provide buoyancy. The hollow guide posts may be made of materials having a specific gravity of less than 1.0. An example of such materials is polyethylene.

What is claimed:

1. A floating platform, comprising: a floating member, the floating member comprising a first receptacle formed therein and a second receptacle formed therein, a first bracket, a second bracket, a first guide post comprising a horizontal blade extending from a side of the first guide post, a second guide post comprising a horizontal blade extending from a side of the second guide post, wherein the horizontal blade of the first guide post is retained within the first bracket and the horizontal blade of the first guide post slidably engages the first bracket; and wherein the horizontal blade of the second guide post is retained within the second bracket and the horizontal blade of the second guide post slidably engages the second bracket; and wherein the first guide post engages and retains the first receptacle of the floating member and the second guide post engages and retains the second receptacle of the floating member and the floating member vertically traverses the first guide post and the second guide post.

2. A floating platform as described in claim 1, wherein the floating member is positioned below the horizontal blade of the first guide post and the horizontal blade of the second guide post.

3. A floating platform as described in claim 1, wherein the first bracket and the second bracket are mounted to a floating object.

4. A floating platform as described in claim 1, wherein the first bracket and the second bracket are mounted to an object fixed to the earth.

5. A floating platform as described in claim 1, wherein the first receptacle and the second receptacle of the floating member are formed of polyethylene.

6. A floating platform as described in claim 1, wherein the first guide post and the second guide post are formed of polyethylene.

7. A floating platform as described in claim 1, wherein the floating member is a boat dock.

8. A floating platform as described in claim 1, wherein the floating member comprises a plurality of floating units assembled as a floating construct.

9. A floating platform as described in claim 1, wherein the first receptacle and the second receptacle of the floating member are cylindrical voids.

10. A floating platform as described in claim 1, wherein the first guide post and the second guide post have an elongated cylindrical shape.

11. A floating platform as described in claim 1, wherein the first guide post and the second guide post comprise a hollow interior and are sealed to prevent water intrusion into the hollow interior.

12. A floating platform as described in claim 1, wherein the first guide post and the second guide post have a specific gravity of less than 1.0.

* * * * *